United States Patent [19]

Thubeauville

[11] Patent Number: 4,497,691

[45] Date of Patent: Feb. 5, 1985

[54] STACK COOLER FOR DRY QUENCHING OF COKE

[75] Inventor: Heinz Thubeauville, Bochum, Fed. Rep. of Germany

[73] Assignee: Dr. C. Otto & Comp. G.m.b.H., Bochum, Fed. Rep. of Germany

[21] Appl. No.: 458,904

[22] Filed: Jan. 18, 1983

[30] Foreign Application Priority Data

Mar. 9, 1982 [DE] Fed. Rep. of Germany ..... 3208415

[51] Int. Cl.[3] ..... C10B 39/02; C10B 45/00

[52] U.S. Cl. ..... 202/228; 34/168

[58] Field of Search ..... 202/227, 228, 268; 201/39; 34/168; 432/77; 110/165 R

[56] References Cited

U.S. PATENT DOCUMENTS

| | | | |
|---|---|---|---|
| 4,282,069 | 8/1981 | Minasov et al. | 202/228 |
| 4,370,203 | 1/1983 | Schmid et al. | 202/228 |
| 4,406,746 | 9/1983 | Dangvillier et al. | 202/228 |
| 4,416,733 | 11/1983 | Likhogub et al. | 201/39 |

FOREIGN PATENT DOCUMENTS

| | | | |
|---|---|---|---|
| 0060972 | 9/1982 | European Pat. Off. | 202/227 |
| 1471589 | 3/1969 | Fed. Rep. of Germany . | |

*Primary Examiner*—Bradley Garris

*Attorney, Agent, or Firm*—Thomas H. Murray; Clifford A. Poff

[57] ABSTRACT

The stack cooler comprises a substantially vertical circular chamber with walls from refractory blocks or bricks. The chamber comprises an upper prechamber and disposed below it the quenching chamber proper, where the prechamber is provided with an upper conical section with a central charging opening. Gas exhaust discharge openings are provided in the transition region between prechamber and quenching chamber over the complete circumference at a distance from each other, which are joining to an annular collection channel running in the masonry. The masonry comprises an outer layer and an inner layer separate from the outer layer over the conical section and also over the cylindrical section disposed below the conical section. The inner layer adjoins at its lower end the masonry work of the wall in the area of the quenching chamber via support walls running between the gas exhaust discharge openings. Advantageously, the inner layer is formed thinner than the outer layer and a narrow slot is left open between these two layers. Preferably, this slot is furnished as a step slot corresponding to the thickness of the bricks or, respectively, of the layers of the masonry work.

18 Claims, 2 Drawing Figures

STACK COOLER FOR DRY QUENCHING OF COKE

BACKGROUND OF THE INVENTION

1. Field of the Invention

The present invention relates to a stack cooler for dry quenching of coke and other lumpy or pelletized fuel materials having a vertical chamber made from refractory blocks or bricks with a tapered top section having a center charging opening, a substantially cylindrical section below the top section and having a bottom discharge opening, and gas exhaust discharge openings along the inside of the vertical chamber joined to an annular collection channel.

2. Brief Description of the Background of the Invention Including Prior Art

A stack cooler for dry quenching of coke is taught in West German Patent Publication No. DE-AS 1,471,589, which relates to the field of the invention set forth above. The masonry work of the stack cooler of DE-AS 1,471,589 is formed from one piece in the cylindrical section as well as in the conical section disposed thereabove. It has been found in practical applications that problems occur with such a masonry construction in the area below the gas exhaust discharge openings and the cause for these problems is associated with the comparatively large pressure loads generated by the weight of the masonry work disposed above. These loads have again and again during operation of the stack cooler resulted in disturbances and in considerable collapses of the masonry work. In order to decrease the support pressure in the lower supporting walls of the stack one can construct the conical part of a lighter weight. Also, it can be attempted to divert the weight of the refractory masonry work of the conical section more to the masonry work outside of the annular collection channel. However, it does not appear that such attempts would result in satisfactory improvements.

SUMMARY OF THE INVENTION

Purposes of the Invention

It is an object of the present invention to provide a lining in the upper area of a stack cooler such that a considerable unloading is achieved in the critical zone of the support wall below the annular collection channel.

It is a further object of the present invention to provide the upper part of a stack cooler from two substantially independent walling layers resulting in less thermal stress of the walls.

It is another object of the present invention to provide a method for the construction of a stack cooler for coke, which results in a cooler less subject to disturbances during operations and to collapses of the inner masonry work.

These and other objects and advantages of the present invention will become evident from the description which follows.

Brief Description of the Invention

The present invention provides a stack cooler for dry quenching of coke and other lumpy fuel materials which comprises a vertical circular chamber formed from refractory materials including a substantially circular prechamber having an upper tapered section narrowing in upward direction and having an inner refractory materials walling and an outer walling, a substantially cylindrical section located below and adjacent to the upper tapered section, and a substantially cylindrical quenching chamber disposed below and adjacent to the bottom of the circular prechamber. A charging opening is disposed at the top of the upper tapered section, a discharging opening for the coke output is disposed at and adjoining to the bottom of the substantially cylindrical quenching chamber, gas discharge openings are disposed at the bottom of the cylindrical section of the prechamber and are spaced at a distance from each other along the circumference, and an annular gas collection channel is disposed behind the walling above the gas discharge openings where the inner walling of the gas collection chamber continues into the inner refractory walling of the upper tapered section and where the outer walling of the gas collection channel continues into the outer walling of the upper tapered section.

The tapered section can take the form of a truncated cone. The taper of the truncated cone can be from about 20 to 40 degrees relative to the cone axis. The tapered section can be provided by an approximate elliptical section narrowing at the top. The inner walling of the upper tapered section can be made from refractory materials. The refractory materials can be provided by brick or block masonry. The outer walling of the tapered section can be provided by brick masonry and the space between the inner walling and the outer walling of the upper tapered section can be provided as an intermediate step slot between masonry comprising horizontal and vertical sections. The thickness of the inner walling can be less than the thickness of the outer walling. The step height can comprise at least the height of a brick or block of the masonry work of the walling. The horizontal sections of the step slot can be provided with a larger slot width as compared to the vertical sections of the step slot. The volume of an intermediate step slot height interval can be from about 2 to 10 percent of the same height interval volume of the inner and outer walling of the tapered section. The annular gas collection channel can have a tapered cross-section at least in part in an upward direction for connection to the interspace step slot between inner and outer masonry walling.

The discharge opening can be provided by a truncated conical section adjoining the bottom of the cylindrical section. An outer gas exhaust discharge opening can be connected to the annular gas collection channel and can be disposed at about a level corresponding to the level of the cylindrical section of the prechamber. The diameter of the substantially cylindrical quenching chamber can be larger than the diameter of the substantially cylindrical section of the prechamber, and the radius of the annular gas collection channel can be about equal to the radius of the cylindrical quenching chamber.

The diameter of the charging opening can be from about 15 to 40 percent of the cylindrical section of the prechamber. The height of the prechamber can be from about one to one and a half times the height of the substantially cylindrical quenching chamber. The inner walling and the outer walling of the upper tapered section can be substantially independent, and the load of the inner walling of the prechamber can result substantially in a loading involving the outer wall at a level which is about below the bottom of the prechamber.

A gas feed can extend to about the center of the bottom of the cylindrical quenching chamber, and a gas feed can extend to about the peripheral part of the discharging opening.

There is also provided a method for constructing a stack cooler for dry quenching of coke which comprises placing a refractory circular masonry wall on a foundation for forming a substantially cylindrical quenching chamber, attaching at a recess at the inside of the upper part of the masonry wall a support wall having gas exhaust discharge openings, constructing an inner upward section onto the support wall for forming a prechamber, which prechamber is tapered at its upper end, and constructing an outer upward section onto the circular masonry wall independent and substantially separate from the inner upward section but substantially following in the upper part the outer contour of the inner upward section for providing an interspace between the inner tapered top section and the outer upward section.

The division according to the invention of the masonry work in the conical and a the following cylindrical section of the stack cooler in two separate parts results in the possibility to divert the larger part of the total load onto the masonry work disposed outside of the annular collection channel and to relieve thereby the inner zone below the gas exhaust openings correspondingly. In addition, the loading at the critical point can be influenced to a large extent by providing the inner layer of the masonry walling in the conical part of less thickness as compared with the outer layer. The use of two independent layers of masonry walling provides the additional advantage that the layers can expand independently from each other. The formation of the masonry walling according to the invention allows, in contrast to a single layer of masonry, a decrease of the load up to about 50 percent at the critical zone of the lower support wall with otherwise the same properties. This unloading of the masonry work and the possibility of an independent expansion of the two layers results in a substantial extension of the life time of such a stack cooler.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing in which is shown one of the various possible embodiments of the present invention.

DESCRIPTION OF INVENTION AND PREFERRED EMBODIMENTS

Figure 1:
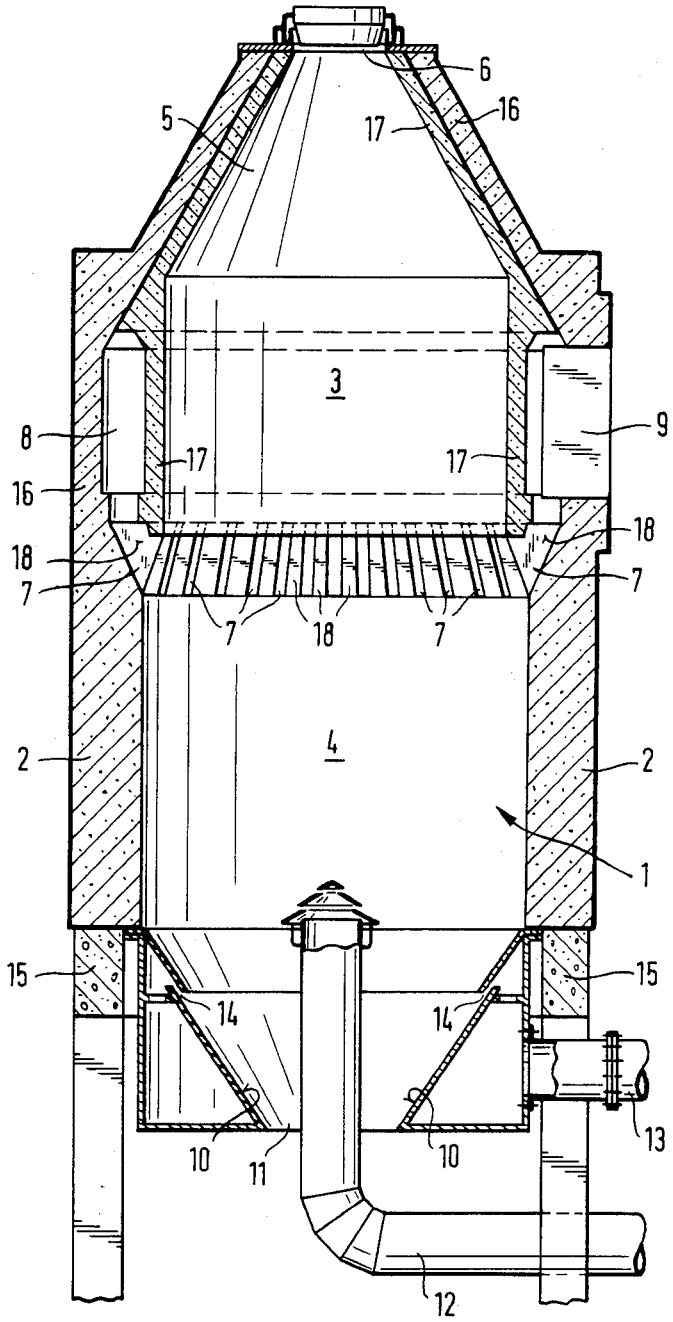
FIG. 1 shows a sectional view of a stack cooler according to the invention.

In accordance with the present invention there is provided a stack or shaft cooler for dry quenching of coke and other lumpy or pelletized fuel materials having a vertical circular chamber formed from refractory stones, bricks or blocks, which chamber is provided with an upper conical section with a central charging opening, and having below a substantially cylindrical section with a bottom discharging opening, where the inner wall of the cylindrical section is furnished with gas exhaust discharge openings along the circumference at a mutual distance, which join into an annular collection channel running above the gas exhaust discharge openings in the lining. The masonry work in the conical section 5 is formed from an outer and an immediately adjoining, however independent inner conical section. The outer layer 16 runs at the bottom into the outer side of the annular collection channel 8 and the inner layer 17 runs into the masonry work surrounding the annular collection channel 8 on the inside.

The inner layer 17 can have a lesser thickness than the outer layer 16. A narrow slot 19 can be provided between the layer 16 and the layer 17. The wall surfaces of the opposing layers can be formed with steps such that they limit the stepped shape of slot 19 made up of horizontal and vertical sections. The step height can correspond to at least the height of one stone of the masonry work. The horizontal sections of the step slot can have a larger slot width as compared to the vertical sections.

The stack cooler comprises an essentially vertical circular chamber 1, the walls 2 of which are furnished from refractory stones, bricks or blocks and which comprises an upper prechamber 3 and below it the quenching chamber proper 4. The prechamber 3 includes an upper conical section 5 having a central charging opening 6.

Gas exhaust discharge openings 7 are disposed in the transition region between prechamber 3 and quenching chamber 4 along the circumference at a distance from each other, which join into an annular ring collection channel disposed above the gas exhaust discharge openings in the wall, and the annular collection channel is connected to the exit opening 9 leading to the outside.

A conical part 10 follows at the bottom end of the quenching chamber 4, which part runs into an opening for the quenched coke. The feed of the drying gas is provided by a central feed pipe 12 and on the other hand via a tube 13 in the lower conical part 10, which is formed from two sections on top of each other, between which is left open a slot 14 for the entering of the dry gas into the interior of the conical part.

The foundation is indicated in FIG. 1 as numeral 15, on which the walling 2 of the shaft cooler rests.

As is shown by way of different shading in FIG. 1, the masonry work comprises an outer layer 16 and an inner layer 17 independent from that outer layer. The inner layer 17 extends from the charging opening 6 down to the gas exhaust discharge openings 7. The inner layer preferably has a thickness which is less as compared with the thickness of the outer layer 16.

As is further illustrated in the drawing, the inner layer 17 of the masonry work runs into support walls 18 in the transition region between prechamber 3 and quenching chamber 4. The support walls 18 extend between the gas exhaust discharge openings 7 and transfer the weight of the inner layer 17 onto the walls 2 surrounding the quenching chamber 4. The lower end of the support walls 18 runs on a joint conical surface expanding downward. The support walls 18 extend upward to the lower side of the annular collection channel 8.

Figure 2:
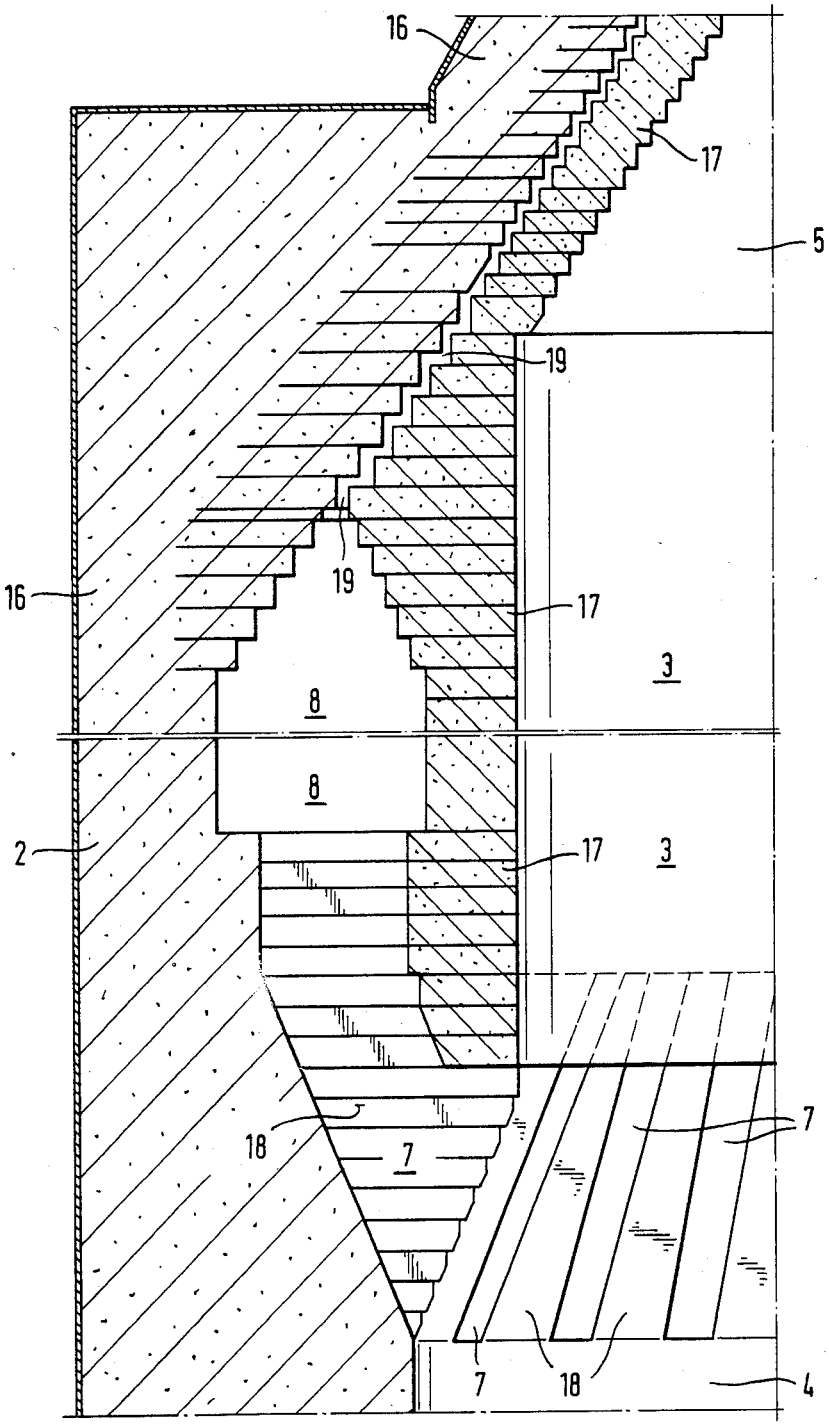
FIG. 2 shows an enlarged partial view, in section, of the stack cooler according to FIG. 1 of the walling of the conical section and cylindrical section therebelow.

Clearly emphasized in FIG. 2 is the construction of the two masonry walling layers 16 and 17. As can be gathered from this representation, a narrow slot 19 exists above the annular collection channel 8 between the two masonry work layers 16, 17, which is formed as a step slot. Here the steps result from the height in each case of the individual layers of the masonry disposed on top of each other. The possibly smallest height of a step corresponds to the height of a stone, brick or block of the masonry.

The width of the slot can be chosen equal or different in horizontal and vertical direction. It is essential that over the full length between the two layers there is provided a continuous slot and thus weight loads are avoided from the outer masonry layer 16 onto the inner masonry layer 17. This way it is assured that the weight of the outer masonry layer 16, which furnishes the larger part of the total load, is transferred exclusively to the masonry work outside of the annular collection channel 8.

The support walls 18 disposed below the annular collection channel 8 are loaded only by the weight of the inner masonry layer 17, which causes a correspondingly lower pressure load as compared with conventional constructions based on the lower total volume, such that overall a substantial unloading is achieved for the support walls 18. In addition, the application of two masonry work parts independent from each other in the region of the prechamber 3 results in the advantages that here different extensions are possible.

It will be understood that each of the elements described above, or two or more together, may also find a useful application in other types of system configurations and quenching procedures differing from the types described above.

While the invention has been illustrated and described as embodied in the context of a stack cooler for dry quenching of coke, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A stack cooler for dry quenching of coke and other lumpy fuel materials comprising:

a vertical circular chamber formed from refractory materials and including a substantially circular prechamber having a charging opening in the top of an upper tapered section which narrows in an upward direction and has an inner refractory materials walling and an outer walling, the inner walling and outer walling being independent and separate with a space therebetween such that the weight loads are not transferred to the other, a substantially cylindrical section located below and adjacent the upper tapered section, said cylindrical section including means forming spaced-apart gas exhaust discharge openings along the circumference and at the bottom of the prechamber, said inner and outer wallings defining an annular gas-collection channel behind the refractory materials of the inner walling above said gas exhaust openings where the inner walling of the gas-collection channel continues to the inner refractory walling of the upper tapered section and where the outer walling of the gas-collection channel continues to the outer walling of the upper tapered section, and a substantially cylindrical quenching chamber disposed below and adjacent the bottom of said circular prechamber, said quenching chamber having a discharge opening disposed at and adjoining the bottom thereof.

2. The stack cooler for dry quenching of coke and other lumpy fuel materials according to claim 1 wherein the tapered section is provided by a truncated cone.

3. The stack cooler for dry quenching of coke and other lumpy fuel materials according to claim 2 wherein the taper of the truncated cone is from about 20 to 40 degrees relative to the cone axis.

4. The stack cooler for dry quenching of coke and other lumpy fuel materials according to claim 1 wherein the tapered section is defined by a generally elliptical section narrowing at the top.

5. The stack cooler for dry quenching of coke and other lumpy fuel materials according to claim 1 wherein the outer walling of the upper tapered section is made from refractory materials.

6. The stack cooler for dry quenching of coke and other lumpy fuel materials according to claim 1 wherein the refractory materials of said inner walling comprise brick masonry.

7. The stack cooler for dry quenching of coke and other lumpy fuel materials according to claim 6 wherein the outer walling of the tapered section is provided by brick masonry and wherein the space between the inner walling and the outer walling of the upper tapered section is an intermediate step slot defined by steps comprising horizontal and vertical sections.

8. The stack cooler for dry quenching of coke and other lumpy fuel materials according to claim 7 wherein the inner walling is of less thickness than the outer walling.

9. The stack cooler for dry quenching of coke and other lumpy fuel materials according to claim 7 wherein the vertical sections comprise at least the height of the brick masonry of the walling.

10. The stack cooler for dry quenching of coke and other lumpy fuel materials according to claim 9 wherein the horizontal sections of the steps are longer than the vertical sections.

11. The stack cooler for dry quenching of coke and other lumpy fuel materials according to claim 7 wherein the annular gas-collection channel has a cross-section at least in part tapered in upward direction and is connected to the intermediate step slot between the inner and outer wallings.

12. The stack cooler for dry quenching of coke and other lumpy fuel materials according to claim 1 wherein the discharge opening is provided by a truncated conical section adjoining the bottom of the cylindrical quenching chamber.

13. The stack cooler for dry quenching of coke and other lumpy fuel materials according to claim 1 further comprising an outer gas exhaust discharge opening connected to the annular gas-collection channel and disposed at about a level corresponding to the level of the cylindrical section of the prechamber.

14. The stack cooler for dry quenching of coke and other lumpy fuel materials according to claim 1 wherein the diameter of the substantially cylindrical quenching chamber is larger than the diameter of the substantially cylindrical section of the prechamber; and wherein the radius of the annular gas-collection channel is about equal to the radius of the cylindrical quenching chamber.

15. The stack cooler for dry quenching of coke and other lumpy fuel materials according to claim 1 wherein the diameter of the charging opening is from about 15 to 40 percent of the diameter of the cylindrical section of the prechamber.

16. The stack cooler for dry quenching of coke and other lumpy fuel materials according to claim 1 wherein the height of the prechamber is from about one to one and a half times the height of the substantially cylindrical quenching chamber.

17. The stack cooler for dry quenching of coke and other lumpy fuel materials according to claim 1 wherein the inner walling of the prechamber is arranged to result substantially in a loading on the outer walling at a level which is about below the bottom of the prechamber.

18. The stack cooler for dry quenching of coke and other lumpy fuel materials according to claim 1 further comprising a gas feed running to about the center of the bottom of the cylindrical quenching chamber, and a gas feed running to about the peripheral part of the discharging opening.

* * * * *